United States Patent [19]

Dohi

[11] 4,184,217

[45] Jan. 22, 1980

[54] PINCH-POINTING MACHINE

[76] Inventor: Kameo Dohi, 992 Rokujo, Chuzu-cho, Yasu-gun, Shiga-ken, Japan

[21] Appl. No.: 903,405

[22] Filed: May 8, 1978

[30] Foreign Application Priority Data

May 9, 1977 [JP] Japan ..... 52/53567

[51] Int. Cl.[2] ..... B23G 9/00; B23G 11/00

[52] U.S. Cl. ..... 10/9; 10/21

[58] Field of Search ..... 10/4, 6, 9, 21, 31, 10/39, 52, 53, 59, 60, 69

[56] References Cited

U.S. PATENT DOCUMENTS

| | | | |
|---|---|---|---|
| 2,263,832 | 11/1941 | Wilcox | 10/9 X |
| 2,652,577 | 9/1953 | Chiaberta | 10/2 |
| 2,740,136 | 4/1956 | Chiaberta et al. | 10/10 R |
| 3,398,413 | 8/1968 | Skierski | 10/21 X |
| 3,717,891 | 2/1973 | Kobylanski | 10/52 X |
| 3,758,900 | 9/1973 | Morton | 10/4 |
| 3,786,527 | 1/1974 | Morton et al. | 10/9 X |

*Primary Examiner*—Ervin M. Combs

*Attorney, Agent, or Firm*—Birch, Stewart, Kolasch & Birch

[57] ABSTRACT

A pinch-pointing machine for forming pilot ends with screws or like fastening devices which comprises a pair of die-heads adapted to move toward and away with respect to each other, a pair of forging dies mounted respectively to the pair of die-heads so as to pinch-point shortly cut blanks therebetween, and a feed dial adjustably movable in three-dimensional directions for feeding the blanks to a center position between the forging dies by means of a plurality of regularly spaced engagement grooves formed in the periphery thereof.

10 Claims, 19 Drawing Figures

PINCH-POINTING MACHINE

BACKGROUND AND SUMMARY OF THE INVENTION

The present invention relates generally to an apparatus for producing screws or the like fastening devices, and more particularly to improvements in a machine for pointing pilot ends of screw blanks or the like prepared by cutting a length of bar stock into pieces of a predetermined size wherein said pilot ends are pinch-pointed by means of a pair of forging dies.

In the production of screws or the like, it has been customary to form a continuity of rough blanks from a length of wire stock between a pair of forging dies, thereafter forming a head section and a shank section with each of the blanks by forging and simultaneously cutting the continuity of those blanks into pieces by forcibly nipping them between the dies, as disclosed in U.S. Pat. Nos. 2,652,577 and 2,740,136. However, according to these methods, a length of bar stock or material is utilized to produce therefrom a desired shape of screws or the like, consequently causing inefficiency as well as high expense in production.

Thus, according to current knowledge in the art, a pinch-pointing machine is employed wherein, prior to the step of forming pilot ends with screws, a desired size of headed blanks are prepared by cutting a length of bar stock into pieces, then the headed blanks are supplied to the pinch-pointing machine to form the pilot ends on the screws, as disclosed in U.S. Pat. Nos. 3,398,413 and 3,758,900. However, the pinch-pointing machines disclosed therein utilize a pair of dies wherein one of them is fixed in position while the other is mounted to a reciprocable die-head so that the latter die is movable back and forth with respect to the former die thereby to forge blanks between the dies. According to this construction, however, each of the blanks cannot be supplied to a center $C_1$ between the two dies as illustrated in FIG. 19, since one of the dies is stationary. As a result, accurate forging cannot be effected and the screw ends formed thereby are not precise in dimension and configuration. Further, the unbalanced arrangement of the pair of dies causes undesirable vibrations and noise in operation, since the plastic deformation of the blanks carried out by one of the dies is not equal to that by the other. Thus, one of the dies wears out more rapidly than the other and therefore must be replaced with new ones after a short span of life, resulting a discontinuance of further pinch-pointing operations, causing a waste of time and labor.

Further, in such a particular case of the conventional nail end pointing machine as disclosed in U.S. Pat. No. 3,717,891, a dial feed mechanism is provided for supply nail blanks intermittently to a forging position between a pair of movable dies which are adapted to squeeze each of the blanks from both sides with equal pressure. However, according to the construction of the machine therein disclosed, the feed mechanism is not provided with an adjusting means for adjustably feeding each of blanks to an accurate center position between the pair of movable dies, wherein centering of feeding blanks must be achieved by adjustably setting the dies, which requires a high degree of skill and a lot of time and labor. If this adjustment is performed imperfectly or inaccurately, the blanks are held unsteady between the dies, this adversely affects the accuracy of the forged products and the life of the dies.

Therefore, an object of the present invention is to eliminate the above-discussed prior art deficiencies.

Another object of the present invention is to provide an improved type of pinch-pointing machine wherein a pair of forging dies are adapted to be relatively accessible from both sides in order to squeeze each blank therebetween with equal pressure when the dies are moved to contact with each other, and mechanism is provided which permits minute adjustment for accurately feeding each blank to a center position between the dies thereby to make it possible to readily and exactly adjust the position of the blanks to the dies, with the additional advantages of enhancing the accuracy of the forging formation as well as balancing the machine, and subsequently for reducing the vibrations and noises in the machine.

A further object of the present invention is to provide an improved pinch-pointing machine which is designed to facilitate double forging or repeated pinch-pointing operation on each single blank.

A still further object of the present invention is to provide an improved pinch-pointing machine wherein a pair of movable dies are arranged so as to increase the durability thereof.

A further object of the present invention is to provide an improved pinch-pointing machine which permits employment of a pair of dies which are easy to manufacture.

Other objects, features and advantages of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
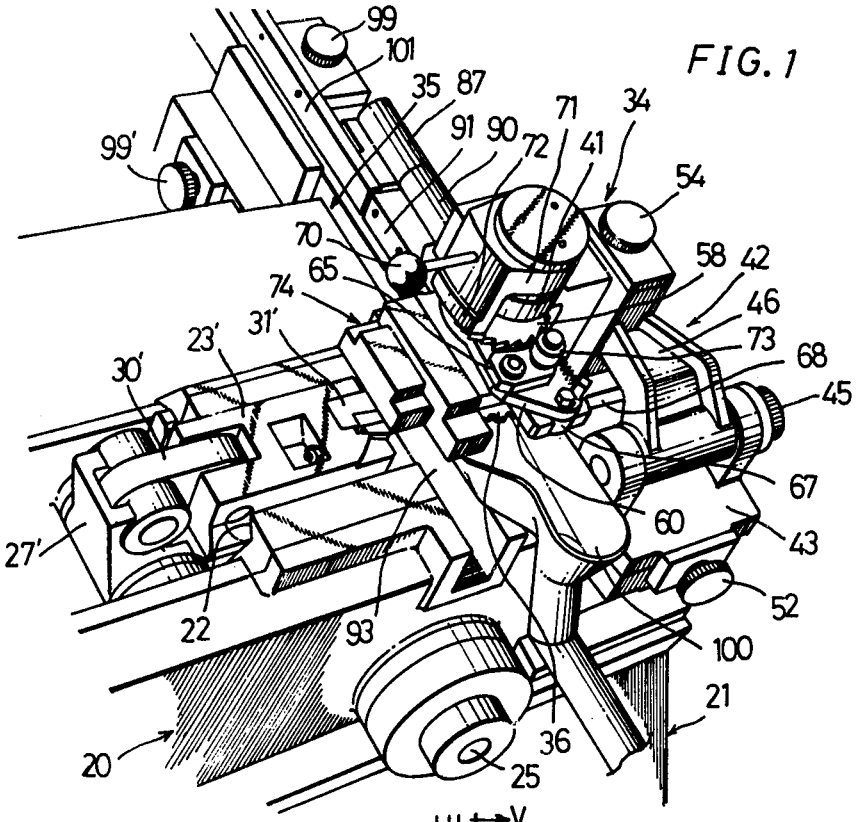
FIG. 1 is a fragmentary perspective illustration showing a pinch-pointing machine of the present invention.
Figure 2:
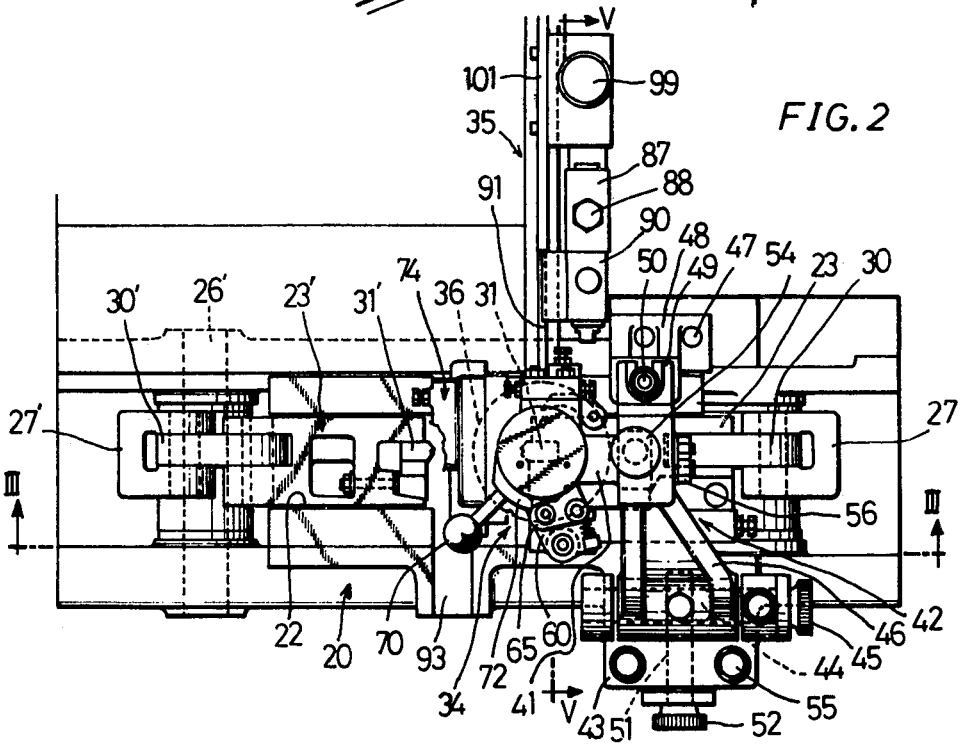
FIG. 2 is a top plan view taken at right angles to the inclined bed of the machine of FIG. 1.
Figure 3:
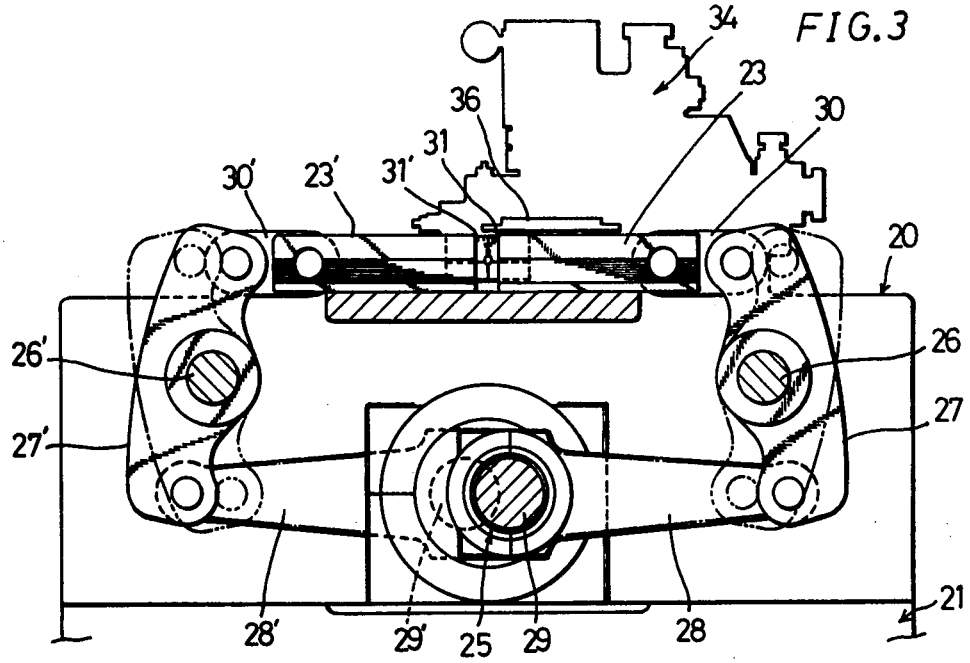
FIG. 3 is a partially schematic sectional elevation taken along the lines III—III of FIG. 2.
Figure 4:
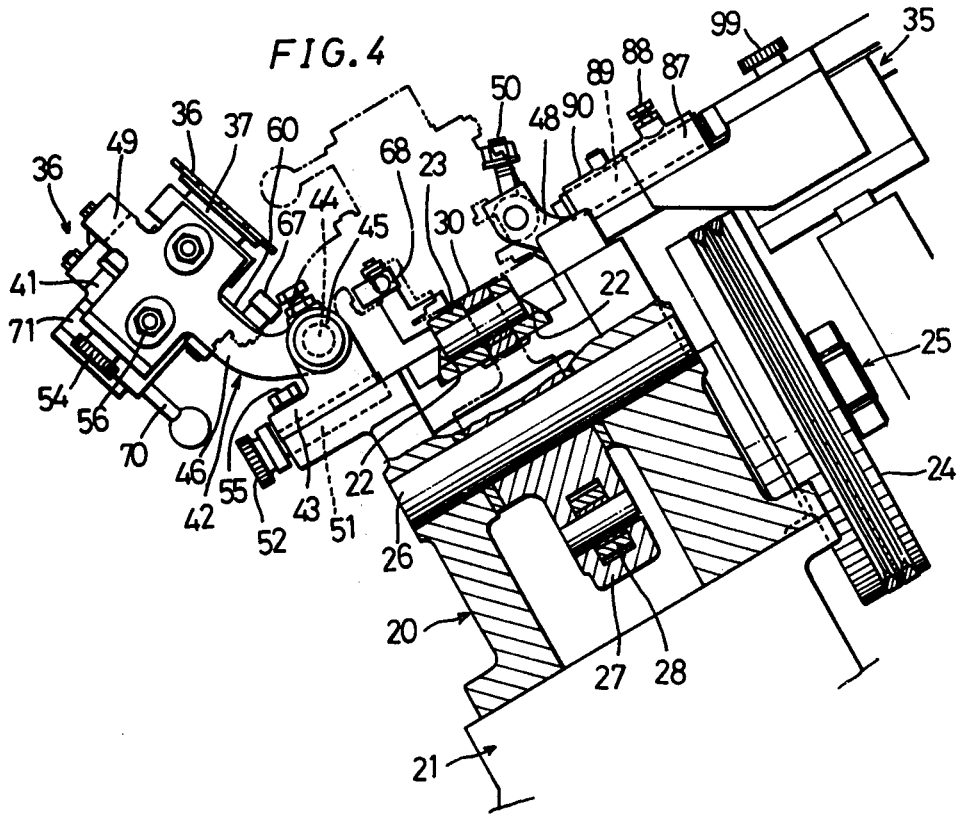
FIG. 4 is a side elevation with parts broken away viewed from the right side of the machine of FIG. 1.

Referring now to the drawings, in particular to FIGS. 1 to 13 and FIG. 18, wherein identical reference numerals are used throughout the various views to indicate identical elements, the pinch-pointing machine of the present invention comprises a bed 20 which is mounted on a base or column 21 affixed to be stationary to the ground in such a manner that the former is inclined by a certain angle with respect to the vertical axis of the latter. The bed is inclined so that its front end is disposed lower than its rear end. The bed 20 is formed with a dovetail groove 22 which extends longitudinally of the bed. A pair of die-heads 23, 23' are slidably mounted to said dovetail groove 22.

In the center of said bed 20 there is mounted a crank shaft 25 to which power is transmitted through a pulley 24 (FIG. 4) from an electric motor (not shown), the crank shaft being disposed so as to extend transversely of the lengthwise axis of the bed 20. On the opposite end portions of the bed 20 there are rotatably supported a pair of shafts 26, 26', respectively, which extend in parallel with said crank shaft 25. Said shafts 26, 26' pivotally support rocking arms 27, 27', respectively. As particularly shown in FIG. 3, the rocking arm 27 has a lower end connected via a rod 28 to a crank pin or eccentric shaft 29 of the crank shaft 25 and an upper end connected via a link 30 to said die-head 23. The other rocking arm 27' has a lower end likewise connected via a rod 28' to a crank pin or eccentric shaft 29' of said crank shaft 25 and an upper end connected via a link 30' to said die-head 23'. The pair of die-heads 23, 23' are adapted to advance relatively forwardly so that they approach to contact with each other and then retreat from contact along with a single rotation of the crank shaft 25.

Figure 16:
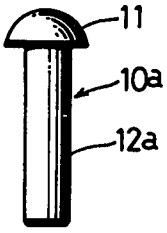
FIG. 16 is a front elevation showing an example of headed screw blanks before being fed to the machine of the present invention.
Figure 14:
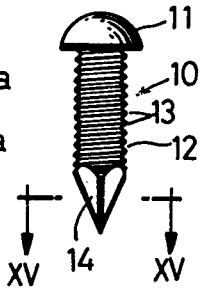
FIG. 14 is a front elevation showing an example of screws threaded after pinch-pointing by the machine of the present invention.
Figure 18:
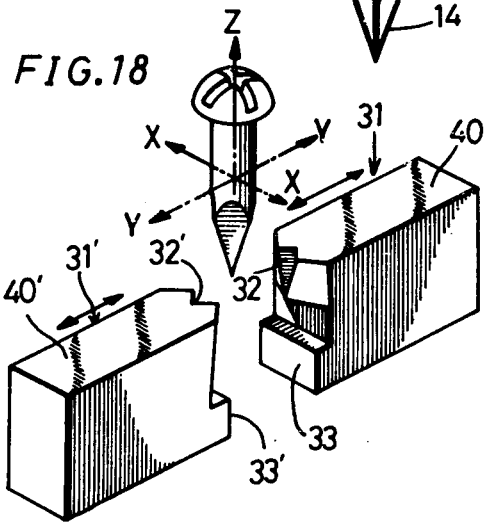
FIG. 18 is a perspective view showing the pinch-pointing operation according to the present invention.
Figure 15:
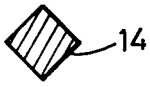
FIG. 15 is an enlarged cross section taken along the lines XV—XV of FIG. 14.

A pair of dies 31, 31' are mounted to opposite forward ends of said die-heads 23, 23', respectively. As particularly shown in FIG. 18, a pair of mating forging recesses 32, 32' are respectively formed in the mating work faces of the oppositely disposed die-heads so that when the die-heads 23, 23' advance forwardly to urge the mating abutments 33, 33' into intimate contact with each other, the lower shank end portion 12*a* of the blank 10*a* shown in FIG. 16 is squeezed within the recesses 32, 32' to form a pointed pilot end 14 shown in FIG. 14. In this regard, it is to be understood that said recesses may be shaped variously thereby to form various configurations of pilot ends such as a conical end, a pyramidal end or others.

Figure 17:
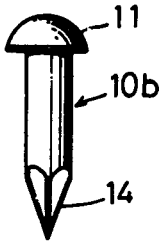
FIG. 17 is a front elevation showing an example of pointed screw blanks pinch-pointed by the machine of the present invention.

The machine of the present invention comprises a feed mechanism 34 which is adaped so that headed blanks 10*a* (FIG. 16) supplied along with a feed track 35 to the rear upper portion of the bed 20 can be fed by intermittent feeding movement of a dial 36 to a position where the mating work faces of the dies 31, 31' contact one another to produce pointed screw blanks 10*b* (FIG. 17) which thereafter are set out into a chute 100. The dial feed mechanism 34 includes a spindle head 41 rotatably supporting a feeding spindle 37 by means of ball bearings 38, 39, said spindle 37 being disposed so as to extend perpendicularly with respect to the top surfaces 40, 40' (FIG. 18) of the dies 31, 31', and a spindle head supporting means 42.

Said supporting means 42 includes a reciprocal carriage 43 mounted on the front upper surface of said bed 20 so as to be slidable transversely of the direction of movement of the die-heads 23, 23', a bracket 46 having a base pivotally supported on the reciprocal carriage 43 by means of a threaded shaft 44 provided with a handle 45, and a platform 48 bolted to the rear upper portion of the bed so as to be adjustably movable in the same direction as the die-heads 23, 23'. In the foremost end of the bracket 46 there is mounted a spindle head 41 so as to be vertically slidable at a right angle to the upper surface of the dies 31, 31'. Said bracket 46 has an ear piece 49 at an end thereof detachably connected to the upper surface of said platform 48 by means of an eye bolt 50 or the like so that by releasing the eye bolt 50, both the bracket 46 and the spindle head 41 mounted thereto may be hinged up together from a position shown in phantom lines in FIG. 4 to a position shown in solid lines in the same figure. In other words the bracket 46 and the spindle 41 are arranged so as to be swingably shiftable upwardly away from the dies 31, 31'.

The reciprocal carriage 43 of said supporting means 42 are reciprocable along an axis X(FIG. 18), namely in the direction transverse to the direction of the movement of the dies 23, 23' by means of a threaded shaft 51 with a handle 52. While the bracket 46 is reciprocable along the axis Y (FIG. 18), namely in the same direction as the movement of the dies 23, 23' by means of said threaded shaft 44 with the handle 45. The spindle head 41 mounted on the foremost end of the bracket 46 is reciprocable along the vertical axis Z(FIG. 18), namely in the direction perpendicular to the top surface 40, 40' of the dies 31, 31' by means of the threaded shaft 53 with a handle 54 whereby the spindle shaft 37 is adjustably movable in the three axial directions X, Y and Z with respect to the dies 31, 31' as clearly shown in FIG. 18. Incidentally, on the reciprocal carriage 43 and the foremost end of the bracket 46 there are mounted bolts 55, 56 for rigidly fixing the carriage 43 and the spindle head 41 in a selectively adjusted position and the bracket 46 is fixed in a position adjusted in the direction of the axis Y by means of a tightening bolt 47 of the platform 48.

Figure 5:
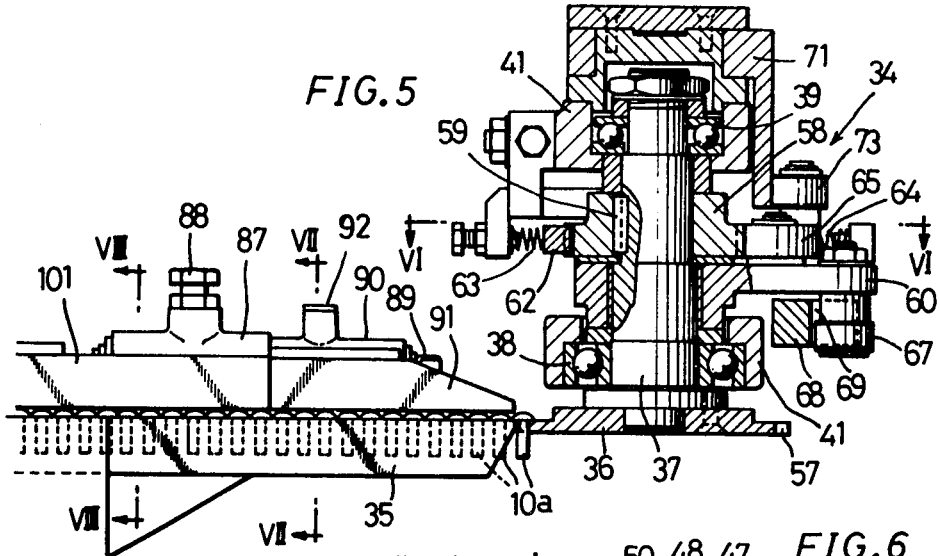
FIG. 5 is an enlarged sectional elevation taken along the lines V—V of FIG. 2.
Figure 6:
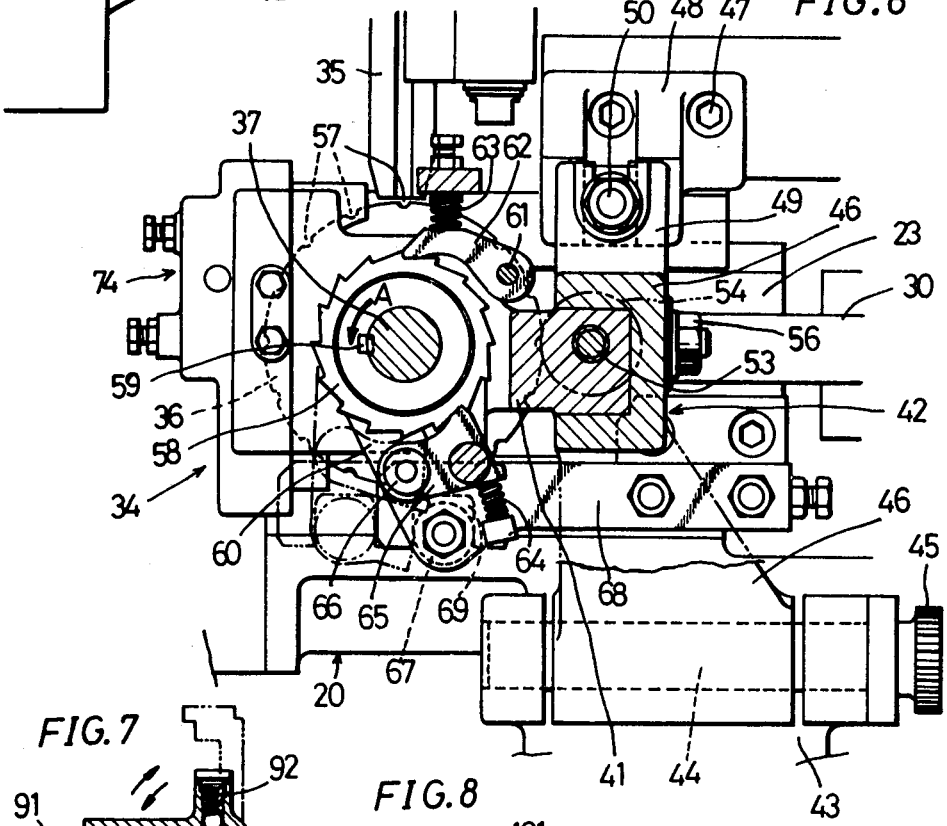
FIG. 6 is a sectional elevation taken along the lines VI—VI of FIG. 5.
Figure 7:
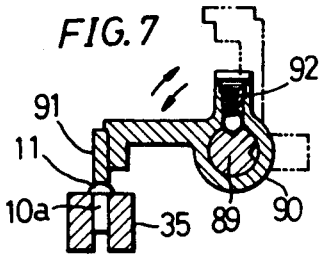
FIG. 7 is a sectional end view taken along the lines VII—VII of FIG. 5.
Figure 8:
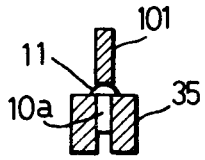
FIG. 8 is a sectional end view taken along the lines VIII—VIII of FIG. 5.
Figure 9:
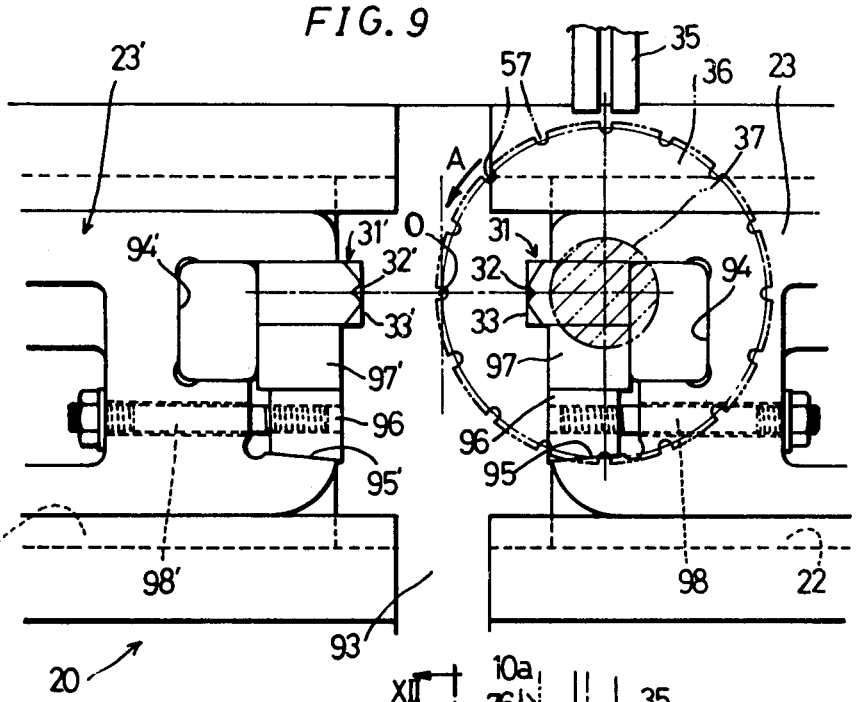
FIG. 9 is a slightly enlarged top plan view showing the dies mounting portion.

In the lowermost end of the spindle shaft 37 of the dial feed mechanism 34 constructed in the above described manner there is mounted the dial 36 provided in the outer periphery thereof with a plurality of engagement grooves 57 at regularly spaced apart intervals and a ratchet 58 is mounted to the spindle shaft 37 with a key 59 (FIG. 5). A pawl lever 60 is rotatably mounted on the spindle shaft 37 and said ratchet 58 is provided with a noback pawl 62 having its one end pivoted on the spindle head 41 via a pin 61 and normally pressed against the ratchet 58 by the pressing force of a spring 63 so as to prevent the ratchet 58 from being rotated reversely in the direction of the arrow A (FIG. 9). An advance pawl 65 is pivotally connected at its one end via a pin 66 to the upper surface of said pawl lever 60 so that the pawl 65 is pressed against said ratchet 58 by means of a spring 64 so as to normally engage said pawl 65 with the ratchet 58 thereby urging the latter so as to be rotated in the direction of the arrow A. Further said pawl lever 60 is provided with a rotor 67 which is protruded from the lower surface of the lever 60 and engaged with a groove 69 of the foremost end of an advance rod 68 rigidly fixed to said die-head 23 so that when the die-head 23 is moved toward the counterpart die-head 23', said advance pawl 65 of the pawl lever 60 is permitted to slip on the ratchet 58 which is kept in anti-reverse rotation, and freely rotate, whereas when the die-head 23 is being moved away from the counterpart die-head 23', the advance pawl 65 is engaged with the ratchet 58 thereby to permit the dial 36 to intermittently rotate through the ratchet 58 and the spindle shaft 37 in accordance with each pitch of the engagement grooves 57 formed in the outer periphery of the dial 37. The spindle head 41 is provided at its upper portion with a cylindrical member 71 having a handle lever 70 which is rotatably mounted in concentrical relation with respect to the spindle shaft 37 so that when the member 71 is rotated by manipulating the handle lever 70, a cam 72 formed peripherally of the member 71 is brought into engagement with a rotor 73 on the upper surface of said advance pawl 65 to rotate the same in the outward direction. As a result, the cylindrical member 71 is released from the rotational relation with the die-head 23 to halt the intermittent movement of the dial 36.

Figure 10:
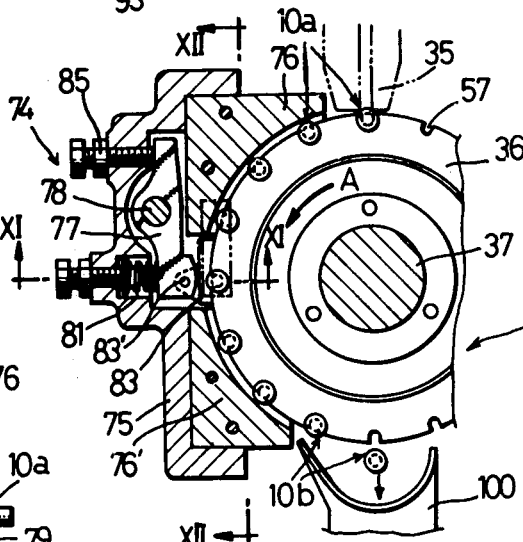
FIG. 10 is a cross sectional view showing the guide mechanism disposed adjacent the feed dial.
Figure 12:
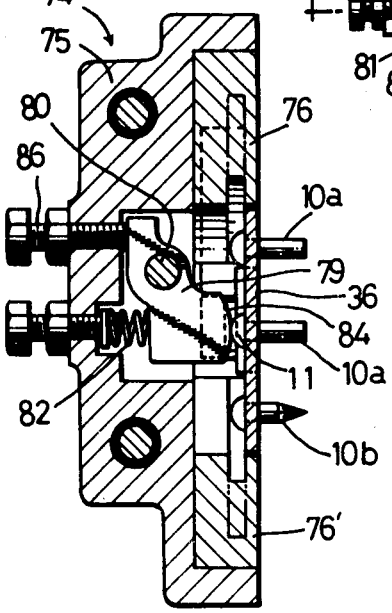
FIG. 12 is an enlarged cross section taken along the lines XII—XII of FIG. 10.
Figure 11:
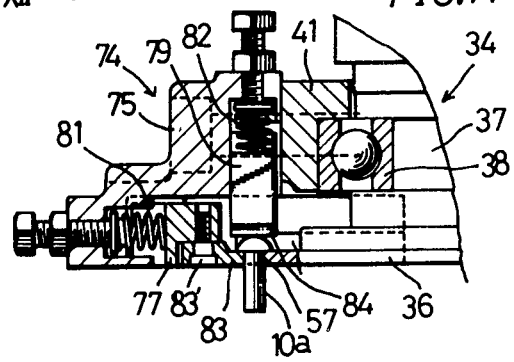
FIG. 11 is an enlarged cross section taken along the lines XI—XI of FIG. 10.
Figure 13:
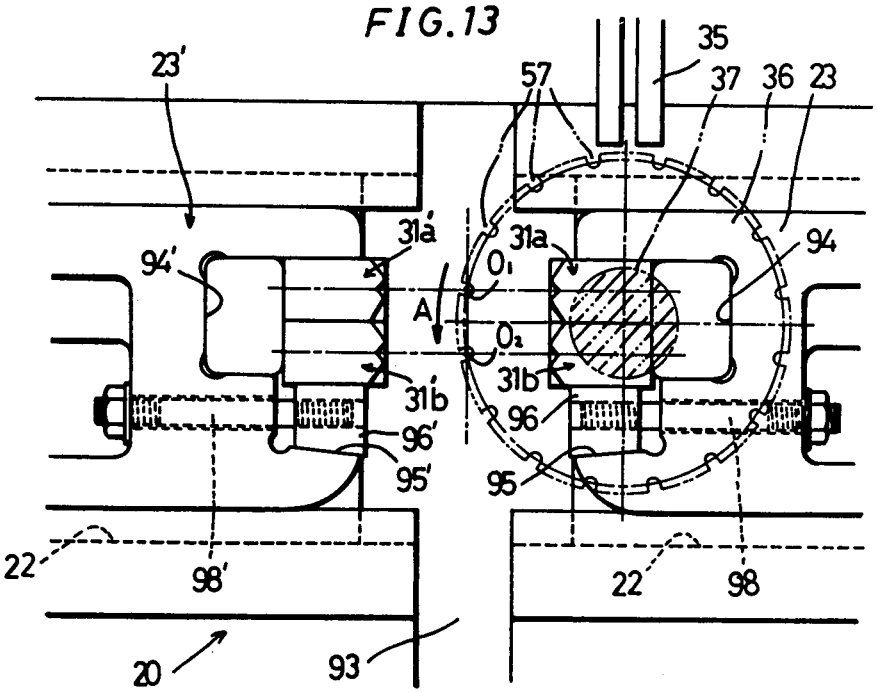
FIG. 13 is a similar view to FIG. 9, particularly showing the operation of repeated pinch-pointing.

In FIGS. 10 to 12 inclusive, a guide mechanism 74 disposed along one side of the spindle head 41 comprises guide plates 76,76' disposed within a casing 75 so as to enclose almost half the circumference of the dial 36 ranging from the corresponding portion of said feed track 35 to that of the chute 100. In position within the casing 75 where the dies 31, 31' are contactable with one another, a shank pusher 77 is swingable radially of the dial 36 and pivotally supported by means of a pin 78. Similarly a further shank pusher 79 is swingable axially of the dial 36 and pivotally supported by means of a pin 88. Further, these shank pushers 77, 79 are normally urged toward the dial 36 by means of said springs 81,82 and a pusher foot 83 fixed to the foremost end of said shank pusher 77 by means of a pin 83' which is forcibly pressed toward the outer periphery of the dial 36, pushing each blank **10*a* into the engagement groove 57 of the dial thereby to prevent the blank 10*a* from disengagement with the groove 57. Said axially swingable shank pusher 79 is adapted so as to urge the head 11 of the blank 10*a* downwardly by an arcuate surface 84 formed in the bottom end thereof, and stopper bolts 85, 86 are mounted in contact with the other ends of said shank pushers 77, 79, respectively, so as to adjust the movement of the pushers. In order that the blank 10*a* can be held very effectively within the engagement groove 57 of the dial 36, it is preferable to form the pusher foot 83 integrally with the shank pusher 77 or otherwise to form the arcuate surface 84 so as to extend substantially in parallel with the upper surface of the dial 36**.

On the boss 87 formed in the foremost end of the feed track 35 facing the dial 36 there is provided a shaft 89 adapted so as to be locked in a selected position by means of a set-screw 88 and adjustably movable in parallel with the feed track 35. In the foremost end of said shaft 89 is rotatably mounted a sleeve 90 provided with an extension cover 91 for pressing each head 11 of the blanks **10*a* that are fed one after another along the feed track 35. Said extension cover 91 is arranged to be freely raised up as particularly shown in FIG. 7 and adapted to be retained by a ball clutch 92 in a first position where the blanks 10*a* are pushed or a second position where the cover is raised up. A feed cover 101 is mounted on the upper portion of the feed track 35 so as to extend in parallel therewith in order to press the blanks 10*a*. The feed cover is selectively adjustable in the distance from the feed track 35 by means of a handle 99 and likewise the width of the feed track 35 per se is also adjustable in width by means of a handle 99'**.

In accordance with the above-described construction of the invention, the blanks **10*a* fed along the feed track 35 are brought one after another into engagement with the groove 57 located at the highest position of the dial 36, and when they are further fed into the center O between the dies 31, 31' along with the intermitted movement of the dial 36 which moves in communication with the rearward movement of the die-head 23, the dies 31, 31' are simultaneously moved to approach one another until the foremost end of the shank portion 12*a* of the blank 10*a* is squeezed from both side with uniform pressure between the dies 31, 31' thereby being forged into the desired shape of a screw end. In the next instance, when the dies 31, 31' are moved away from one another, the dial 36 is moved intermittently by each pitch in communication with the retreat of the dies, whereby the forged blank 10*b* thus formed with its pilot end is fed toward the chute 100 from the forging area of the dies. In synchronism therewith, said area is supplied with the next blank 10*a* to forge it to form the same pilot end therewith by means of the dies 31, 31'. When said blank 10*b* reaches the lowermost position opposite to the feed track 35, it falls off the engagement groove 57 by its own gravity to drop into a chute 100, while the scrapped chips produced from the blank 10*a* when forged are discharged out of the machine in turn through a groove 93 formed aslope on the bed 20**.

As is readily apparent from the foregoing description, the blank **10*a* held in the engagement groove 57 of the dial 36 is moved adjustably in both directions of the axis X transverse to the direction of the movement of the dies 31, 31' and in the direction of the axis Y the same as said direction of the lateral movement of the dies 31, 31', so that the shank portion 12*a* of the blank 10*a* can be accurately positioned to the center O of the recesses 32,32' when the dies 31, 31' contact one another. Since the shank portion 12*a* is forged by squeezing the same between the pair of movable dies 31, 31' which are adapted to approach from both sides, the shank 12*a* can be held steady between the dies in during the forging operation, which results in a plastic deformation rate which is always kept equal between the dies and this prevents the forged pilot end of the blank from being irregularly deformed. In other words, the shank end is forged exactly into the same shape of said recesses 32, 32', thus excessively enhancing the precision of forged articles, compared with those produced by any one of the conventional pinch-pointing machines, with the additional advantages of equalizing the wear of the two dies 31, 31' and reducing very effectively the noises and vibrations that otherwise always go with the conventional pinch-pointing machines. According to the present invention, it is also very easy to forge the blank 10***a* into such a shape eccentrical of its center merely by feeding the blank 10*a* to a position where the center of the blank 10*a* is purposedly shifted closer to either the axis X or to the axis Y than said center. More specifically, since the machine of the invention permits selectively feeding the blanks 10*a* both in the directions of axes X and Y, it is quite feasible to change the operation so as to forge or pinch-point a single blank 10*a* as many as two times. For the this purpose, the dial 36 is mounted to the spindle shaft 37 in half pitch shifted position as particularly shown in FIG. 13, and the die-heads 23, 23' are provided with a first pair of dies 31*a*, 31*a'* and a second pair of dies 31*b*, 31*b'* mounted respectively at same spaced apart intervals as those of the engagement grooves 57 of the dial 36. The center of the engagement groove 57 in the dial 36 should be set to each center $O_1$, $O_2$ of said first and second pairs of dies 31*a*, 31*a'* and 31*b*, 31*b'* by adjusting in the directions of axes X, Y. In this case, the feed track 35 also should be moved along with the movement of the dial 36. By so doing, the blank 10*a* fed in engagement with the groove 57 is roughly forged between the first pair of dies 31*a*, 31*a'* and thereafter fed into the second pair of dies 31*b*, 31*b'* in communication with the retreat of the die-heads 23, 23', finally to be forged into a desired exact shape between the second pair of dies 31*b*, 31*b'*. By repeating the forging or pinch-pointing operations two times, the blank end 10*a* is forged into a delicate shape, or into a pyramidal shape formed with sharp cutting edges, as occasions need. Further according to the machine of the present invention, it is also possible to selectively change the height of the position where the blank 10*a* is to be forged merely by adjutably moving the spindle shaft 37 and the dial 36 in the vertical direction of an axis Z with respect to the dies 31, 31'. The selection of said height is also available by replacing the dial 36 with other similar dials having a different width. As has been fully described in the foregoing, the blank 10*a* is not only squeezed from both sides with equal pressure between the dies that are movable to one another but also selectively moved in any direction of the axes X and Y so that the plastic deformation in each dies is made uniform enough to guarantee the precision of forged articles, equalizing the durability of the pair of dies. Further, due to the movability of the blanks in either direction of the axes X and Y, eccentric shape articles are also producible, as desired. Furthermore, since the pair of die-heads are arranged so as to move in the opposite directions, the machine is well balanced and undesirable vibrations and noises are remarkably reduced, which permits operation at high speed.

Further, most of the conventional forging dies in general use are made, as well known to those skilled in the art, by grinding and electric discharge machining of a sintered hard alloy produced by powder metallurgical method for the purpose of enhancing the durability of the dies. In the conventional method of replaceably mounting these dies made of sintered hard alloy to die-heads, it has been necessary to form, for example, a cone-shaped recess in one side of each die so that the foremost end of a clamping bolt tightly screwed into the die-head is forcibly engaged into said mounting recess as disclosed in U.S. Pat. No. 3,398,413. However, the operation of forming the cone-shaped recess in one side of the die inevitably requires the operation of electrical discharge machining with the side of the dies for the purpose of engraving the engaging recess corresponding to said cone-shaped recess, thus giving rise to an expensive cost of manufacture. Besides, when the above-mentioned engraving operations are carried out, the hard alloy tends to lose the balance of its internal stress due to the residual distortion caused to the metallic composition of the hard alloy when heat-treated, consequently concentrating the internal stresses on the forging recesses or other cavities of the dies. Therefore, the dies, while operating with a high intensity of work, must be repeatedly subject to concentrated internal stresses on the recesses or cavities in addition to said internal stress caused by the residual distorsion.

According to the present invention, however, said pair of dies 31, 31' are disposed within the die-mounting recesses 94, 94' formed in the forward ends of said die-heads 23, 23', respectively, while inner sides 95, 95' of either of said recesses 94, 94' are formed to provide tapered surfaces so as to gradually reduce the width of each of the recesses as they approach the innermost portion of the recess. Between each of said tapered inner sides 95, 95' and each of said dies 31, 31', there are inserted wedge-shaped liners 96, 96' either with or without spacers 97, 97'. Thereafter, said liners 96, 96' are rigidly tightened rearwardly of the die-heads 23, 23' by means of bolts 98, 98' inserted respectively into the die-heads 23, 23' in parallel relation therewith. Thus, the dies 31, 31' are accurately and readily replaceably mountable to the die-heads 23,23' by the pressure of the wedge-shaped liners 96, 96' against the tapered inner sides 95, 95', consequently making it unnecessary to engrave a cone-shaped or like engaging recess in the side of the die by the electric discharging machining. As a result, the sintered hard alloy-made-dies can maintain balance of internal stresses in composition without concentrating the stress on the recesses. Thus, said deficiencies in the prior art can be effectively eliminated. In fact, it has been proved by experiments that the forging dies incorporated together with the pinch-pointing machine of the present invention can be extended in its durability as much as twice, as compared to the conventional dies.

Figure 19:
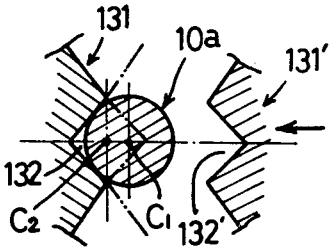
FIG. 19 is a schematic cross section showing a typical example of a prior art pinch-pointing operation.

Further, since the spindle shaft 37 and the dial 36 mounted thereto are so constructed that they are permitted to be raised up together with the spindle head 41 in the direction of withdrawing from the dies, it is possible to easily replace the dies with new ones and also to selectively apply the latter to the die-heads. Further, since the dial 36 is adapted to move intermittently in communication with the retreating movement of the die-head 23, the intermittent rotation of the dial can be easily carried out with exact intervals as well as the construction thereof can be quite simplified. In this case, it is also possible to easily adjust the positions of the pair of dies so that the work faces thereof can be accurately and intimately opposed with each other by test pinch-pointing operation under condition that the rotation of the dial 36 is stopped by disengaging the dial from communicating movement of the die-heads. Further in operation, each of the blanks 10*a* are held in the groove 57 by the two shank pushers 77, 79 which act on the shank portion and the head portion of the blank 10*a*, respectively, whereby the blank 10*a* is firmly held in position and prevented from being expelled out of position during pinch-pointing operation. Furthermore, since a pair of movable dies are adapted to move forwardly from both sides, the blank 10a can be pinch-pointed in the center of the pair of two dies, thereby eliminating the deficiency that the center $C_1$ of the blank and the center $C_2$ of the forging formation are not located on the same point as clearly illustrated in FIG. 19.

The invention being thus described, it will be obvious that the same may be varied in many ways. Such variations are not to be regarded as a departure from the spirit and scope of the invention, and all such modifications as would be obvious to those skilled in the art are intended to be included within the scope of the following claims.

I claim:

1. A pinch-pointing machine for pointing shanks of work blanks comprising:

a pair of die-heads operatively supported on a machine bed and selectively movable in a lateral direction toward and away from each other;

a pair of forging dies, one of said forging dies being mounted on an end of each of said die-heads and operatively positioned so that when said pair of die-heads move toward each other, a shank portion of a work blank is plastically deformed therebetween by means of said forging dies;

a feed dial positioned above said forging dies and rotatably supported on an axis orthogonal to the lateral direction of movement of said forging dies;

a plurality of engagement grooves formed on the periphery of said feed dial;

said engagement grooves being regularly spaced apart from one another;

each of said engagement grooves being adapted to accommodate a single work blank therein;

a feed track having one end positioned adjacent to said feed dial for feeding a plurality of said blanks successively to each of said engagement grooves;

said feed dial being adjustably mounted to be selectively movable in the same lateral direction of movement as said die-heads; and said feed dial being adjustably mounted to be movable in a direction transverse to said lateral direction of movement of said die-heads and on a parallel plane therewith.

2. The pinch-pointing machine according to claim 1, which includes die-mounting recesses formed in forward ends of each of said pair of die-heads and having an inner width, said die-mounting recesses each having at least one internal side surface tapered at an angle with respect to the other internal side surface, substantially wedge-shaped liners each having at least one tapered surface being interposed between said internal tapered side surface of said die-mounting recesses and a side surface of each of said forging dies, each of said internal tapered side surfaces of said die-mounting recesses and each of said tapered surfaces of said liners being in contact with each other to reduce the inner width of said die-mounting recesses, and tightening means for clamping said liners.

3. The pinch-pointing machine according to claim 1 or 2, wherein a first pair of forging dies being mounted to one of said pair of die-heads, a second pair of forging dies being mounted to the other of said pair of die-heads, and said first pair of forging dies and said second pair of forging dies defining two work areas being spaced apart the same interval as said regularly spaced apart engagement grooves.

4. The pinch-pointing machine according to claim 1 or 2, wherein said feed dial is movable in an orthogonal direction to said lateral direction of movement of said die-heads.

5. The pinch-pointing machine according to claim 1 or 2, wherein said feed dial is operatively mounted to be displaced away from said forging dies.

6. The pinch-pointing machine according to claim 5, wherein said feed dial is connected to one end of a bracket which is pivotally connected to a reciprocal carriage supported on said bed and operatively movable in a direction transverse to said lateral movement of said die-heads, said bracket being movable about a shaft which extends parallel to said lateral movement of said pair of die-heads and being adjustably movable along its axial direction.

7. The pinch-pointing machine according to claim 1 or 2, wherein said feed dial includes:

a locking means for fixing said feed dial to a position in a direction transverse to said lateral movement of said die-heads, and a second locking means for fixing said feed dial to a position in the same direction as said lateral movement of said die-heads.

8. The pinch-pointing machine according to claim 1 or 2, including means for intermittently rotating said feed dial as said die-heads are moved away from each other.

9. The pinch-pointing machine according to claim 8, wherein said means for rotating the feed dial intermittently includes means for disengaging movement of said feel dial from the movement of said die-heads.

10. The pinch-pointing machine according to claim 1 or 2, wherein said feed dial is operatively positioned adjacent to a first pushing means for pushing a shank portion of said work blank against said feed dial as well as a second pushing means for pushing a head portion of said work blank against said feed dial.

* * * * *